US009463554B2

(12) United States Patent
Blake, III

(10) Patent No.: US 9,463,554 B2
(45) Date of Patent: Oct. 11, 2016

(54) PLASTIC CLAMP AND METHOD OF MANUFACTURING THE SAME

(75) Inventor: Thomas E. Blake, III, South Lyon, MI (US)

(73) Assignee: Illinois Tool Works Inc., Glenview, IL (US)

( * ) Notice: Subject to any disclaimer, the term of this patent is extended or adjusted under 35 U.S.C. 154(b) by 3007 days.

(21) Appl. No.: 10/914,878

(22) Filed: Aug. 25, 2004

(65) Prior Publication Data

US 2006/0043662 A1 Mar. 2, 2006

(51) Int. Cl.
*B25B 5/10* (2006.01)
*B25B 5/16* (2006.01)

(52) U.S. Cl.
CPC ..... *B25B 5/101* (2013.01); *B25B 5/163* (2013.01)

(58) Field of Classification Search
CPC ..... B25B 5/067; B25B 5/082; B25B 5/101
USPC ..... 269/249, 143, 173; 29/257
See application file for complete search history.

(56) References Cited

U.S. PATENT DOCUMENTS 1,498,638 A * 6/1924 Periolat ..... 269/47
2,768,664 A * 10/1956 Morgan ..... 269/203
2,923,334 A * 2/1960 Brennan, Jr. ..... 269/147
3,735,923 A * 5/1973 Brigham et al. ..... 238/10 E
3,947,011 A * 3/1976 Tsuyama ..... 269/249
3,997,152 A * 12/1976 Sass et al. ..... 269/249
4,074,899 A * 2/1978 Hochstetler ..... 269/249
5,135,209 A * 8/1992 Penny ..... 269/249
5,241,736 A * 9/1993 Allison ..... 29/469.5
5,298,215 A 3/1994 Krause
5,427,364 A * 6/1995 Zborschil ..... 269/166
5,586,373 A * 12/1996 Eby et al. ..... 24/525
5,971,378 A * 10/1999 Sweeney ..... 269/6
6,746,006 B2 * 6/2004 Thomas ..... 269/6
6,971,642 B2 * 12/2005 Carnell ..... 269/249
7,047,610 B2 * 5/2006 Dawson ..... 29/281.1
2006/0043662 A1 * 3/2006 Blake, III ..... 269/249

FOREIGN PATENT DOCUMENTS

DE 0553609 8/1993

* cited by examiner

*Primary Examiner* — Lee D Wilson
(74) *Attorney, Agent, or Firm* — Joseph M. Butscher; The Small Patent Law Group, LLC

(57) ABSTRACT

A clamp (10) comprises a plastic molded threaded screw portion (12) and a molded U-shaped plastic clamp portion (26). The U-shaped plastic clamp portion (26) has two legs (28, 30) projecting from a base (32). One of the two legs (28) has molded plastic threads (29) which engage plastic threads (15) of the plastic threaded screw portion (12). The plastic molded screw portion (12) has a swivel portion (20) which swivels relative to the plastic molded screw portion. A method of making an injection molded plastic clamp (10) comprises molding a first plastic clamp portion (12) in a mold, molding a second U-shaped plastic clamp portion (26) to the first clamp portion in a mold containing the first clamp portion to form an assembled injection molded plastic clamp.

10 Claims, 5 Drawing Sheets

PLASTIC CLAMP AND METHOD OF MANUFACTURING THE SAME

TECHNICAL FIELD

The present invention is directed to a plastic clamp and a method of manufacturing the plastic clamp.

BACKGROUND OF THE INVENTION

A known clamp comprises an assembly of parts made of plastic or metal. The components of the clamp are separately manufactured plastic or metal components which are assembled together after they are manufactured. There is a need for a clamp which consists of a minimum number of components and which can be produced without manual assembly of individual parts.

SUMMARY OF THE INVENTION

The present invention is a method of making an injection molded plastic clamp. The method comprises the steps of molding a first plastic clamp portion in a mold and molding a second U-shaped plastic clamp portion to said first clamp portion in a mold containing said first clamp portion to form an assembled injection molded plastic clamp. The molding steps include molding a part of the first plastic clamp portion and a part of the second U-shaped plastic clamp portion wherein parts enable relative movement of the clamp portions to clamp an item between the clamp portions.

According to another aspect of the method, the step of molding the second-U-shaped plastic portion includes the step of molding two legs of the U-shaped plastic clamp portion which project from a base.

According to another aspect of the method, the steps of molding the first plastic clamp portion and the second U-shaped plastic clamp portion includes providing a first plastic material for molding the first plastic clamp portion and providing a second plastic material for molding the second U-shaped plastic clamp portion which does not form a melt bond with the first plastic material.

According to another aspect of the method, the step of molding a first plastic clamp portion includes the step of molding threads on the first plastic clamp portion, and the step of molding the U-shaped plastic clamp portion includes molding on one of the two plastic legs plastic threads which threadedly engage the plastic threads of the threads on the first clamp portion so that relative rotation of the threads cause relative movement of the first clamp portion and the other of the two legs to cause a clamping force to be applied to an item by the first plastic clamp portion and the other leg portion.

According to another aspect of the method, a ball portion of the first plastic clamp portion is molded on a first terminal end thereof.

According to another aspect of the method, a swivel is molded around the ball portion of the first plastic clamp portion.

According to another aspect of the method, protective pads are molded onto the swivel and onto the second leg.

According to another aspect of the method, molding the protective pads includes the step of molding from a material which forms a melt bond with the material of the second leg of the second U-shaped plastic clamp portion and the swivel so that the protective pads are chemically bonded to the surface by the molding and are permanently attached to the swivel and the second leg.

The present invention is also directed to a clamp. The clamp comprises a plastic molded threaded screw portion and a molded U-shaped plastic clamp portion. The U-shaped plastic clamp portion has two legs projecting from a base. The plastic threaded screw portion and the U-shaped plastic clamp portion are molded of different plastics. One of the two legs has molded plastic threads which engage plastic threads of the plastic threaded screw portion. Relative rotation of the threads causes movement of the plastic threaded screw portion toward the other of the two legs to cause a clamping force to be applied to an item located between the plastic threaded screw portion and the other leg portion. The plastic molded screw portion has a swivel portion which swivels relative to the plastic molded screw portion.

According to another aspect of the invention, a first protective pad is located on the swivel and a second protective pad is located on the second leg.

According to another aspect of the invention, the first protective pad is molded onto the planar surface of the swivel and the second protective pad is molded onto the second leg facing opposite the planar surface of the swivel.

According to another aspect of the invention, the first protective pad is chemically bonded to the swivel and the second protective pad is chemically bonded to the second leg by the molding so that the protective pads are permanently attached to the swivel and the second leg, respectively.

According to another aspect of the invention, the first and second protective pads are mechanically secured to the swivel and the second leg via a mechanical joint connection and the protective pads are removable at the joint connection.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 1:
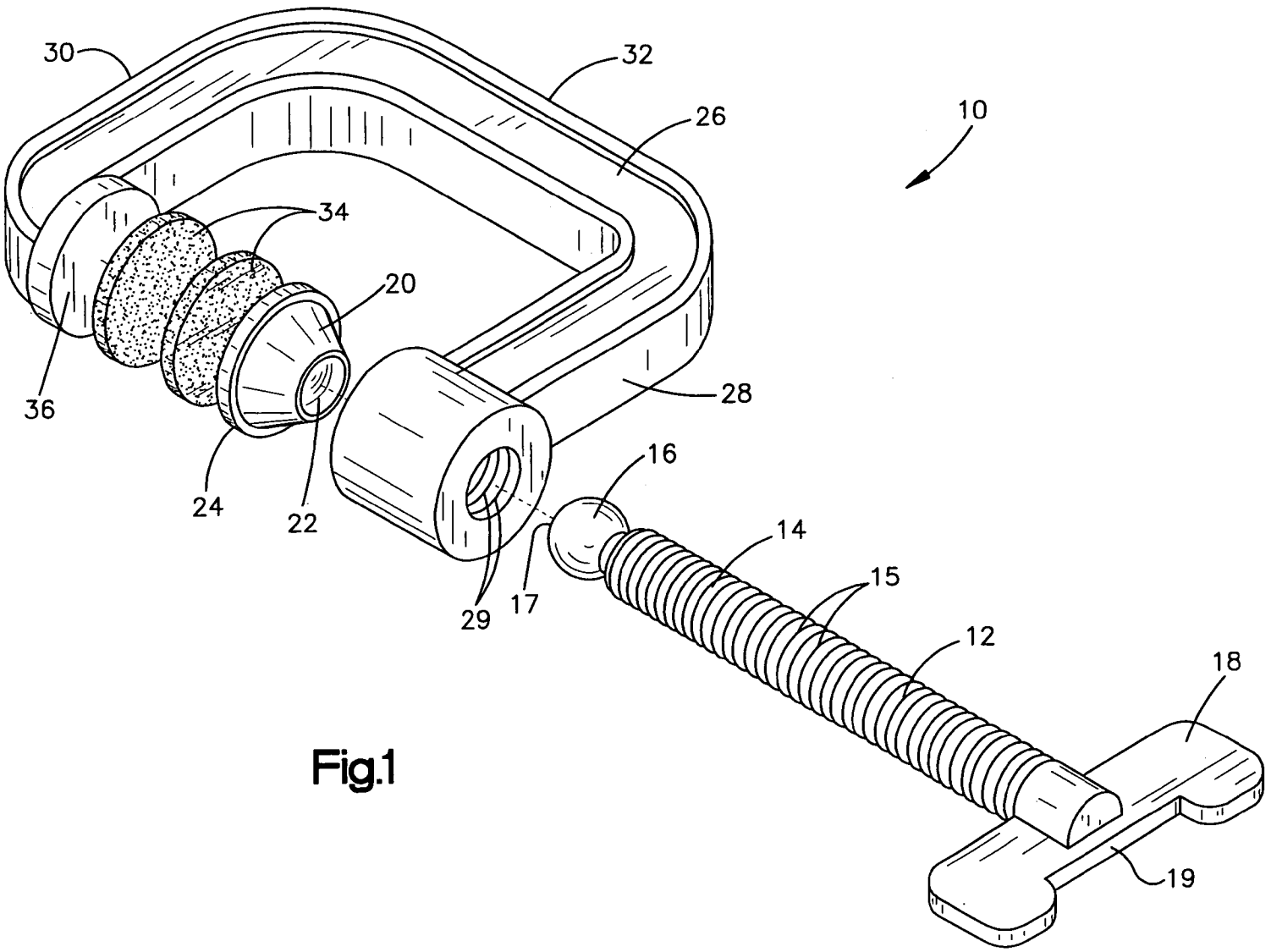
FIG. 1 is an exploded perspective view of an exemplary clamp constructed in accordance with a first embodiment of the invention.
Figure 2:
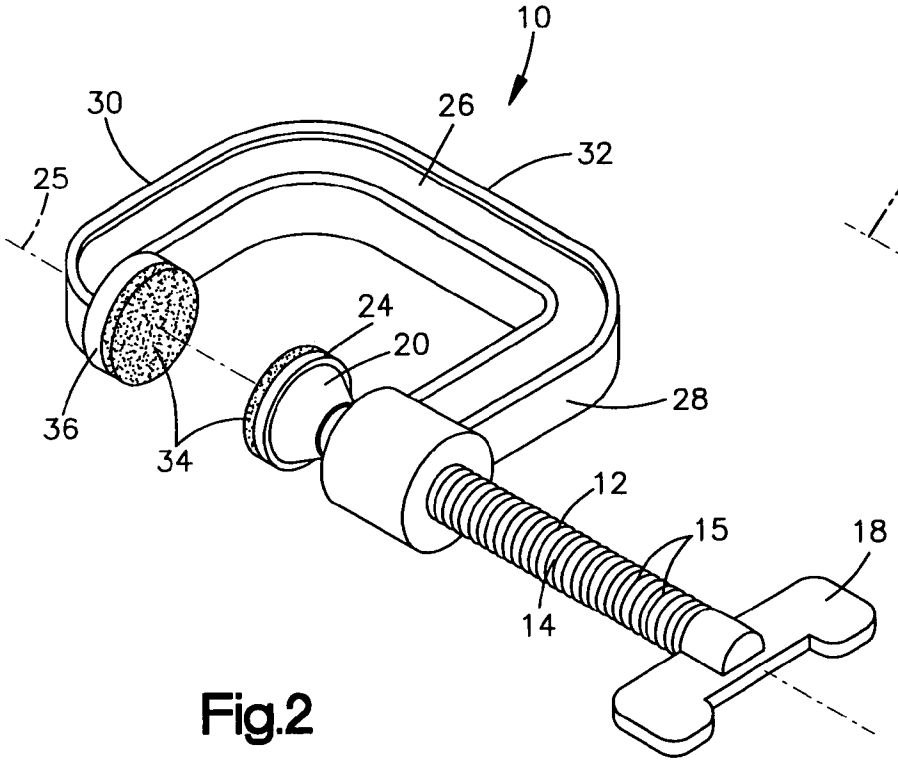
FIG. 2 is a further view of the clamp of FIG. 1 in an assembled condition.

The present invention is directed to a plastic clamp and a method of manufacturing the plastic clamp. FIG. 1 illustrates an exploded perspective view of an exemplary clamp constructed in accordance with a first embodiment of the invention. FIG. 2 illustrates a view of the clamp in an assembled condition.

The clamp 10 includes a screw 12, a swivel 20, a U-shaped clamp portion 26 and protective pads 34. The screw 12, swivel 20, U-shaped clamp portion 26 and protective pads 34 are all made of plastic and are molded into an assembled unit by an in-mold assembly process which will be discussed in further detail below.

The screw 12 includes an elongated threaded shaft 14 and a ball portion 16 molded to the threaded shaft on a terminal end 17. The threaded shaft 14 comprises external threads 15. A turning handle 18 is located on the screw 12 on the opposite terminal end 19 of the threaded shaft 14.

A swivel 20 is molded to the ball portion 16 of the screw 12. The swivel 20 has a socket portion 22 which engages with the ball portion 16 to form a ball and socket joint. The swivel 20 has a planar surface 24 on the side opposite the socket portion 22. The swivel 20 swivels relative to the ball portion 16 of the screw 12 about the axis 25.

The clamp 10 includes a molded U-shaped clamp portion 26. The U-shaped clamp portion 26 has first and second legs 28, 30 projecting from a base 32. The first leg 28 of the U-shaped clamp portion 26 has molded plastic threads 29. The threads 29 are internal threads which threadedly engage with the external threads 15 of the screw 12 (FIG. 3).

A protective pad 34 or cushion is made of elastomeric material and is molded on the swivel 20 and the second leg 30 of the U-shaped clamp portion 26 onto the planar surface 24 of the swivel 20 and onto the surface 36 of the second leg 30 facing opposite the planar surface of the swivel. The protective pads 34 are chemically bonded to the surfaces 24 of the swivel 20 and the surface 36 of the second leg 30 when molded.

Relative rotation of the screw 12 and U-shaped clamp portion 26 is achieved by turning the turning handle 18. This causes movement of the screw 12 away from the first leg 28 and toward the second leg 30 of the U-shaped clamp portion 26 to cause a clamping force to be applied to an item (not shown) located between the swivel 20 and the second leg 30 of the clamp 10. The protective pads 34 help to protect the item from marring while the item is clamped.

Figure 4:
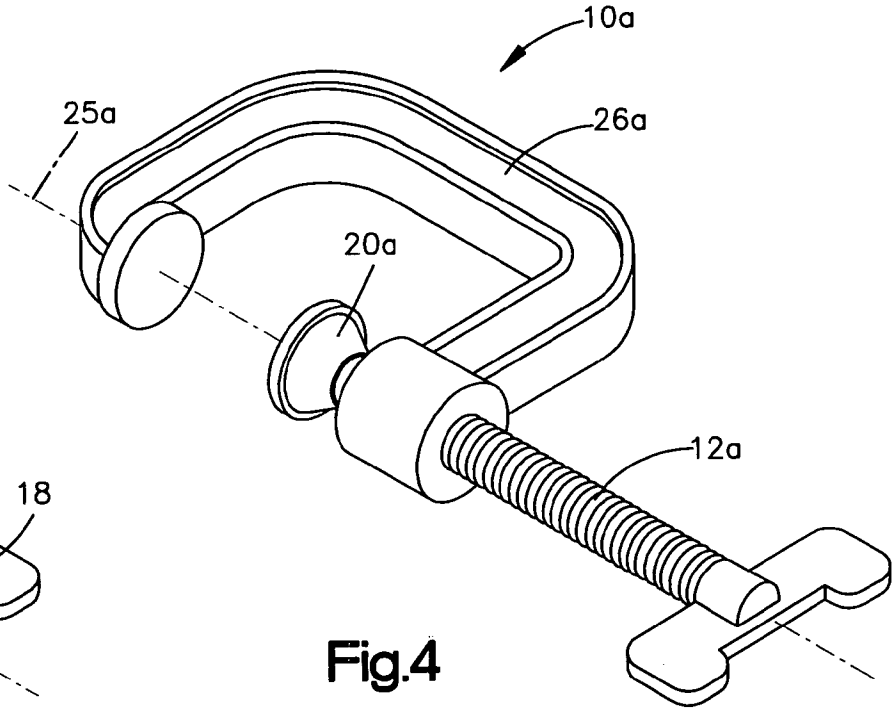
FIG. 4 is a further view of the clamp of FIG. 3 in an assembled condition.
Figure 3:
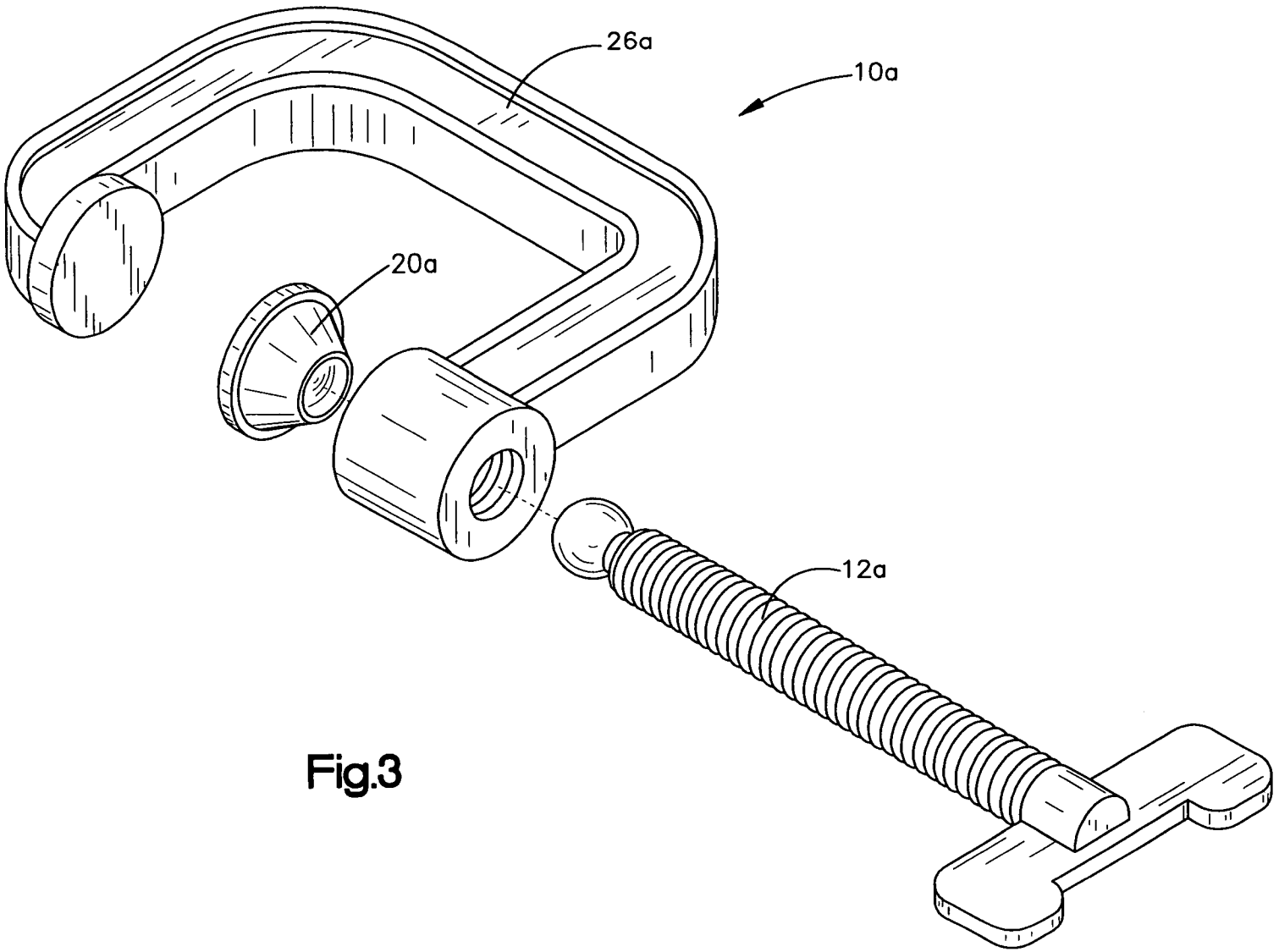
FIG. 3 is an exploded perspective view of a clamp constructed in accordance with a second embodiment of the invention.

FIG. 3 is an exploded perspective view of a clamp 10*a* constructed in accordance with a second embodiment of the invention. FIG. 4 is a further view of the clamp 10*a* of FIG. 3 in an assembled condition. The clamp 10*a* includes a screw 12*a*, a swivel 20*a*, and a U-shaped clamp portion 26*a*. The swivel 20*a* swivels relative to the screw about the axis 25*a*. The screw, swivel 20*a* and U-shaped clamp portion 26*a* are made of plastic and are molded into an assembled unit by an in-mold assembly process which will be discussed in further detail below. The only structural difference between the clamp 10 and the clamp 10*a* is that the clamp 10*a* has no protective pads.

The plastic clamp 10, 10*a* may be molded of any suitable thermoplastic material. Some examples of suitable thermoplastic materials from which the plastic clamp 10, 10*a* may be molded are polythalamide, nylon 6, nylon 66, nylon 46, nylon 12, polyphenylene sulfide (PPS), or Polybutylene terephthalate (PBT).

The screw 12, 12*a* and the U-shaped clamp portion 26, 26*a* are molded of different plastic materials. The screw 12, 12*a* is molded from a thermoplastic material such as polythalamide. The U-shaped clamp portion 26, 26*a* and the swivel 20, 20*a* are molded from the same thermoplastic material such as glass-filled Nylon, DuPont ZYTEL™, or DSM STANYL™. Polythalamide and glass-filled Nylon, ZYTEL™, or STANYL™ are dissimilar materials in that they have different chemical properties making them difficult to bond or adhere to one another. However, if desired, the plastic materials can be made to bond to one another with the use of a separate adhesive.

Concerning the first embodiment of the clamp 10, the protective pads are molded from a thermoplastic material different than the thermoplastic material used for forming the screw 12, U-shaped clamp portion 26 and swivel 20. The protective pads 34 may be molded of any thermoplastic elastomer (TPE). Six broad TPE types are styrenics (mainly SEBS—styrene-ethylene-butylene-styrene); thermoplastic polyolefin elastomers (TPO); thermoplastic vulcanizates (TPV); thermoplastic polyurethane elastomers (TPU) such as polyester and polyester urethanes; copolyester thermoplastic elastomers (COPE); and copolyamide thermoplastic elastomers (COPA). For example, the protective pads 34 may be molded from a thermoplastic vulcanizate such as SANTOPRENE™.

The screw 12, 12*a*, the U-shaped clamp portion 26, 26*a*, the swivel 20, 20*a* and the protective pads 34 may be molded from other thermoplastic materials in addition to the specific examples listed here. However, the thermoplastic material of the screw 12, 12*a* cannot be the same material as the U-shaped portion 26, 26*a* or the swivel 20, 20*a*.

Figure 5:
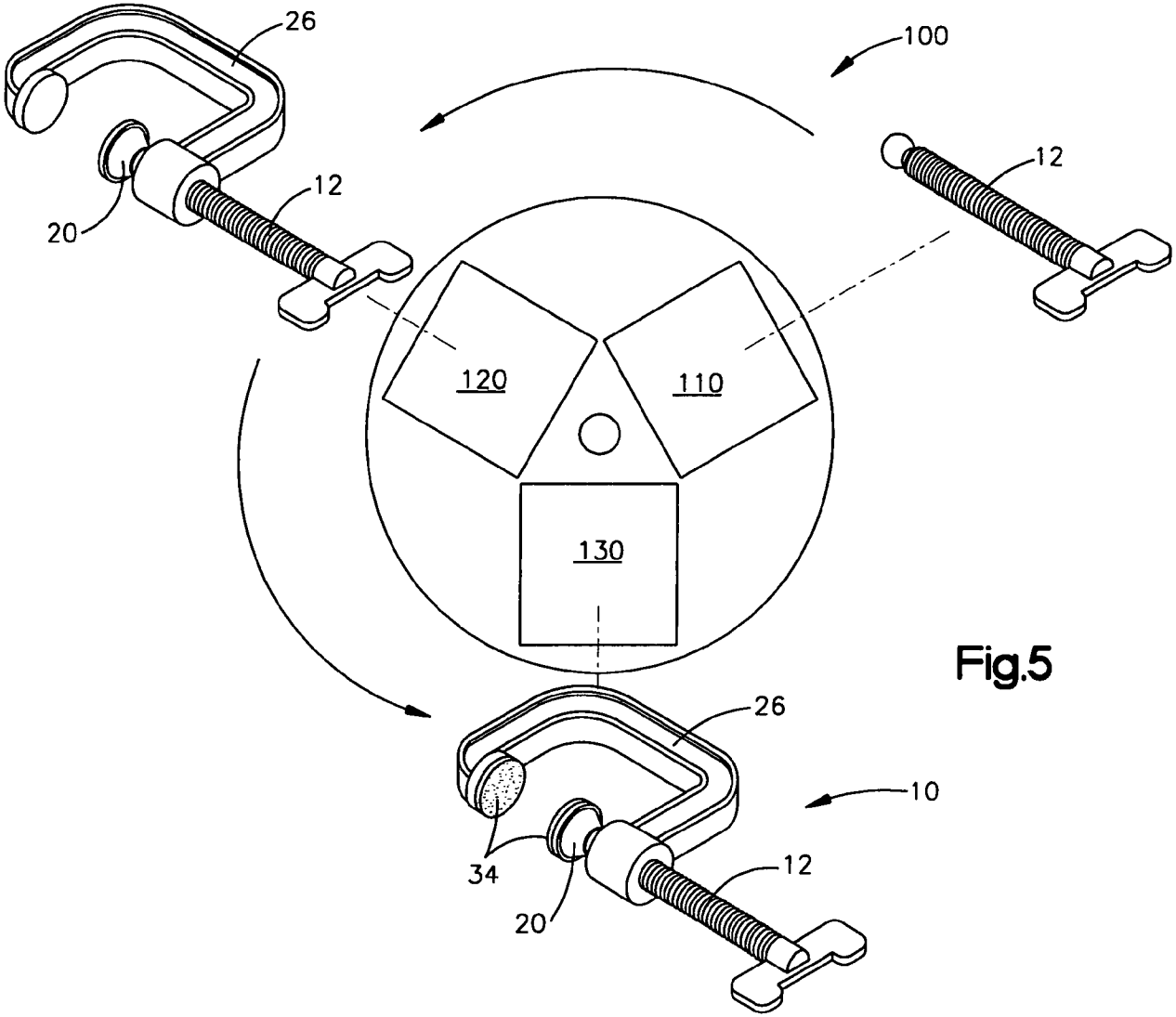
FIG. 5 is a schematic illustration of a method of molding a clamp in accordance with the first embodiment of the invention.

FIG. 5 is a schematic view of the method of molding the first embodiment of the clamp 10 according to FIGS. 1-2 of the present invention. The screw 12, U-shaped clamp 26, swivel 20 and protective pads 34 are formed as one assembled unit during an in-mold assembly technique known as multi-shot injection mold technology. The screw 12, U-shaped clamp 26, swivel and protective pads 34 of the clamp 10 are molded into a single structure by this technique.

The assembled unit of the screw 12, U-shaped clamp 26, swivel 20 and protective pads 34 formed by the in-mold assembly technique eliminates the need for subsequent assembly of the screw 12, U-shaped clamp 26, swivel 20 and protective pads 34 after molding takes place. In addition, the assembly unit of the screw 12, U-shaped clamp 26, swivel 20 and protective pads 34 eliminates the need for separate fasteners or screws or any other type of separate fastening means to connect the screw 12, U-shaped clamp 26, swivel 20 and protective pads 34 together after molding takes place.

With respect to the clamp 10 shown in FIGS. 1-2, the screw 12 is molded first, the U-shaped clamp portion 26 and swivel 20 are simultaneously molded second and the protective pads 34 are molded third.

The in-mold assembly process 100 has a first injection station (not shown) for injecting the first plastic material into a first mold cavity 110 defining the screw 12. Molding the screw 12 is the first shot of the multi-shot injection molding process 100.

After molding takes place, the screw 12 is removed from the first cavity 110 and inserted into a second mold cavity 120. The in-mold assembly process has a second injection station (not shown) for injecting the second thermoplastic material into the second mold cavity 120 to simultaneously mold the U-shaped clamp portion 26 and the swivel 20 as one unit with the screw 12. Simultaneously molding the U-shaped clamp portion 26 and the swivel 20 is the second shot of the in-mold assembly process 100.

The molded screw includes molded external threads 15 that define part of the mold for subsequently molding internal threads 29 on the U-shaped clamp portion 26. The second mold cavity 120, the external threads 15 of the screw 12 together define the mold for the U-shaped clamp portion 26 and the internal threads 29 for molding the U-shaped clamp portion 26 with the screw into an assembled unit. In addition, the second mold cavity 120 and ball portion 16 of the screw 12 defines the mold for molding the swivel 20. A socket portion 22 of the swivel 20 is molded around the ball portion 16 of the screw 12.

The melting point of the plastic material used to mold the screw 12 is higher than the melting point of the plastic material used to simultaneously mold both the U-shaped clamp portion 26 and the swivel 20 in the second shot. Thus, the screw 12 does not melt during molding of the swivel 20 and U-shaped clamp portion 26. The U-shaped clamp portion 26 and the swivel 20 are molded at the same time, in the same mold cavity 120, and from the same plastic material.

Plastic materials have inherent shrinkage rates which can be used to calculate the amount of shrinkage of a molded part as the plastic cools. During the in-mold assembly process 100 with respect to the clamp 10 shown in FIGS. 1-2 of the present invention, the plastic material of the screw 12 is injection molded first to form external threads 15 and a ball portion 16 which are predefined by a geometry in the first mold cavity 110.

The external threads 15 define a boundary onto which the plastic material of the U-shaped clamp portion 26 is subsequently injected at the second injection station to form internal threads 29. The ball portion 26 also defines a boundary onto which the plastic material of the swivel 20 is subsequently injected at the second injection station to form a socket 22.

Because the melting point of the plastic material used to form the screw 12 is higher than the melting point of the plastic material used to form both the swivel 20 and the U-shaped clamp portion 26, the screw 12 can function as part of the mold used to form the U-shaped clamp portion and the swivel.

As it cools, the plastic material of the swivel 20, the screw 12, and the U-shaped clamp portion 26 at the location of the external threads 15 and the socket 22 shrink leaving a clearance area to allow the swivel 20 and the internal threads 29 of the U-shaped clamp portion 26 to threadedly engage and rotate relative to the screw 12.

The plastic material used to mold the screw 12 is different from the plastic material used to mold both the U-shaped clamp portion 26 and swivel 20 in that the plastic materials have dissimilar properties. The plastic material of the screw 12 does not adhere to or bond with the plastic material of both the swivel 20 and U-shaped clamp portion 26 during the in-mold assembly process 100.

After both the U-shaped clamp portion 26 and the swivel 20 are molded as one unit with the screw 12, the molded structure is removed from the second mold cavity 120 and inserted into a third mold cavity 130. The assembled unit of the molded U-shaped clamp portion 26 and swivel 20 define part of the mold for subsequently molding the protective pads 34 in the in-mold assembly process 100.

The in-mold assembly process 100 has a third injection station (not shown) for injecting the third thermoplastic material into the third mold cavity 130 to mold the protective pads 34 as one unit with the molded swivel 20 and U-shaped clamp portion 26.

The third mold cavity 130, the molded unit of the swivel 20 and U-shaped clamp portion 26 together define the mold for the protective pads 34 for molding the protective pads with the molded screw 12, swivel 20 and U-shaped clamp portion 26 into a single molded structure.

During the in-mold assembly process 100, a melt bond, or chemical bond, is formed between the U-shaped clamp portion 26 and the protective pad 34 as well as between the swivel 20 and the protective pad 34. Thus, the materials selected to mold the U-shaped clamp portion 26 and the swivel 20 is bondable with the materials selected to mold the protective pads, such as the thermoplastic vulcanizate SANTOPRENE™ which is bondable to nylon.

After the protective pads 34 are molded with the screw 12, swivel 20 and U-shaped clamp portion 26, the in-mold assembly process of molding the clamp 10 is finished. The clamp 10 is a molded assembly. The clamp 10 is ejected from the third mold cavity 134. No further assembly is required before the clamp 10 is used by consumer.

Alternatively, instead of the screw 12 being molded first during the in-mold assembly process 100, the U-shaped clamp portion 26 and swivel 20 can be molded first. In this case, the materials used to mold the screw 12 are wholly interchanged with the materials used to mold the U-shaped clamp portion 26 and swivel 20.

Figure 6:
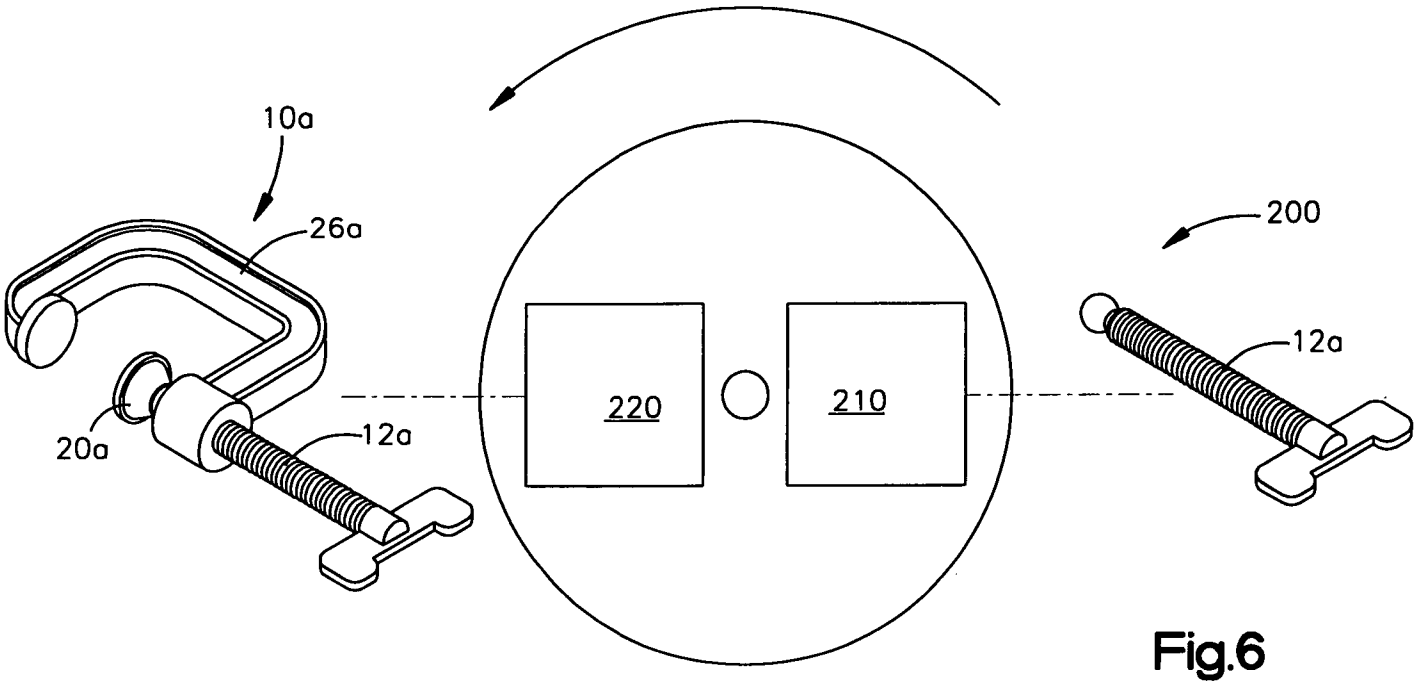
FIG. 6 is a schematic illustration of a method of molding a clamp in accordance with the second embodiment of the invention.

FIG. 6 is a schematic view of the method of molding the second embodiment of the clamp 10*a* according to FIG. 4 of the present invention. The clamp 10*a* does not include protective pads. With respect to the clamp 10*a* shown in FIG. 4, the screw 12*a* is molded first and the swivel 20*a* and U-shaped clamp portion 26*a* are simultaneously molded second. There is no third mold station in the in-mold assembly process 200. Rather, the first and second mold cavities 210, 220 are located in a rotatable mold part which can rotate 180° between the mold cavities 210, 220.

Referring to FIG. 6, the in-mold assembly process 200 has a first injection station (not shown) for injecting the first thermoplastic material into a first mold cavity 210 for defining the screw 12*a*. Molding the screw 12*a* is the first shot of the multi-shot injection molding process 200. After the screw 12*a* is molded, it is removed from the first mold cavity 210, travels 180° to the second mold cavity 220 and is inserted into the second mold cavity 220. Alternatively, the mold itself can be rotated 180° from the first mold cavity 210 to the second mold cavity 220.

The in-mold assembly process 200 has a second injection station (not shown) for injecting the second thermoplastic material into the second mold cavity 220 to simultaneously mold the U-shaped clamp portion 26*a* and the swivel 20*a* as one unit with the screw 12*a*. Simultaneously molding the U-shaped portion 26*a* and the swivel 20*a* is the second shot of the in-mold assembly process 200.

The molded screw 12*a* defines part of the mold for subsequently molding the U-shaped clamp portion 26*a* and the swivel 20*a*. The second mold cavity 220 and the screw 12*a* together define the mold for the U-shaped clamp portion 26*a* and the swivel 20*a* for simultaneously molding the U-shaped clamp portion 26*a* and the swivel 20*a* with the screw 12*a* into an assembled unit.

The melting point of the thermoplastic material used to mold the screw 12*a* is higher than the melting point of the thermoplastic material used to mold the U-shaped clamp portion 26*a* and the swivel 20*a*. The screw 12*a* does not melt during the molding of the U-shaped clamp portion 26*a* and the swivel 20*a*.

Because the melting point of the thermoplastic material used to form the screw 12*a* is higher than the melting point of the thermoplastic material used to form the U-shaped clamp portion 26*a* and the swivel, the screw 12*a* can function as part of the mold used to form the U-shaped clamp portion 26*a* and the swivel 20*a*.

As it cools, the thermoplastic material of the U-shaped clamp portion 26*a*, the swivel 20*a* and the screw 12*a* shrink leaving a clearance area to allow the U-shaped clamp portion to rotate relative to the screw and to allow the swivel to rotate around the ball portion of the screw.

The plastic material used to mold the screw 12*a* is different from the plastic material used to mold the U-shaped clamp portion 26*a* and the swivel 20*a* in that the plastic materials have dissimilar properties. The plastic material of the screw 12*a* does not adhere to or bond with the plastic material of the U-shaped clamp portion 26*a* and the swivel 20*a* during the in-mold assembly process 200.

After the U-shaped clamp portion 26*a* and the swivel 20*a* is molded as one-piece with the screw 12*a*, the one-piece molded structure is ejected from the second mold cavity 220. After the swivel 20*a* is molded with the screw 12*a* and U-shaped clamp portion, the in-mold assembly process 200 is finished. The clamp 10*a* is a molded assembled unit. No further assembly is required before the clamp is 10*a* used by a consumer.

Alternatively, instead of the screw 12*a* being molded first during the in-mold assembly process 200, the U-shaped clamp portion 26*a* and swivel 20*a* can be molded first. In this case, the materials used to mold the screw 12*a* are wholly interchanged with the materials used to mold the U-shaped clamp portion 26*a* and swivel 20*a*.

The molded plastic clamp of the present invention is suited for use in generic clamping applications and is especially suited for hobby work due to the low forces required and the need to protect the work from marring.

From the above description of the invention, those skilled in the art will perceive improvements, changes and modifications.

It should be understood that, instead of the protective pads 34 being permanently attached to the surfaces 24 and 36, the protective pads may not be permanently attached to the surfaces 24 and 36 but may instead be removable. For example, protective pads may be mechanically secured to the swivel 20 and second leg 30, via a mechanical connection. The mechanical connection can be a common ball and socket type connection or another type such as a dove tail connection.

If the protective pads 34 are mechanically attached to the surfaces 24 and 36, the swivel 20 and the surface 36 of the U-shaped clamp portion 26 would have a modified construction. In the modified construction, a ball is molded on the planar surface of the swivel 20 and another ball is molded on the surface of the U-shaped clamp portion 26 opposite the swivel. The protective pads 34 include a socket which is molded around the ball on the swivel and the ball on the U-shaped clamp.

In addition, the protective pads would be molded of a different plastic material which does not chemically bond to the swivel or the surface of the U-shaped clamp portion so that the protective pads are removable from the swivel and the second leg and replaced with a new set of protective pads.

In this case, during an in-mold assembly process for molding the modified clamp construction, the melting point of the plastic material used to mold the screw 12, swivel 20 and U-shaped clamp portion 26 is higher than the melting point of the plastic material used to mold the protective pads 34. As a result, the thermoplastic material used to mold the molded screw 12, swivel 20 and U-shaped clamp portion 26 does not melt during the molding of the protective pads 34. Consequently, the molded screw 12, swivel 20 and U-shaped clamp portion 26 can function as part of the mold used to form the protective pads 34 to form an assembled unit.

It also should be understood that, instead of the screw 12 and U-shaped clamp portion 26 being threaded, the screw 12 and the U-shaped clamp portion 26 may instead have a ratcheted surface and a pawl. The screw 12 and U-shaped clamp portion 26 may operate in the manner of a pawl and ratchet so that movement of the screw 12 towards the second leg 30 causes a clamping force to be applied to an item located between the screw and the second leg of the clamp.

Such improvements, changes and modifications within the skill of the art are intended to be covered by the appended claims.

Having described the invention, the following is claimed:

1. A clamp comprising:

a plastic molded threaded screw portion, and a molded U-shaped plastic clamp portion, said U-shaped plastic clamp portion having two legs projecting from a base, said plastic threaded screw portion and said U-shaped plastic clamp portion being molded of different plastics;

one of said two legs having molded plastic threads which engage plastic threads of the plastic threaded screw portion, relative rotation of said threads causing movement of said plastic threaded screw portion toward said other of said two legs to cause a clamping force to be applied to an item located between said plastic threaded screw portion and said other leg portion; and said plastic molded screw portion having a swivel portion which swivels relative to said plastic molded screw portion.

2. The clamp according to claim 1 further comprising a first protective pad located on the swivel and a second protective pad located on the second leg.

3. The clamp according to claim 2 wherein the first protective pad and a planar surface of the swivel have a molded connection and the second protective pad and the second leg facing opposite the planar surface of the swivel have a molded connection.

4. A clamp comprising:

a plastic molded threaded screw portion, and a molded U-shaped plastic clamp portion, said U-shaped plastic clamp portion having two legs projecting from a base, said plastic threaded screw portion and said U-shaped plastic clamp portion being molded of different plastics;

one of said two legs having molded plastic threads which engage plastic threads of the plastic threaded screw portion, relative rotation of said threads causing movement of said plastic threaded screw portion toward said other of said two legs to cause a clamping force to be applied to an item located between said plastic threaded screw portion and said other leg portion; and said plastic molded screw portion having a swivel portion which swivels relative to said plastic molded screw portion, a first protective pad located on the swivel and a second protective pad located on the second leg, the first protective pad and the swivel having a chemical bond and the second protective pad and the second leg having a chemical bond by the molding so that the protective pads are permanently attached to the swivel and the second leg, respectively.

5. The clamp according to claim 2 wherein the first and second protective pads are mechanically secured to the swivel and the second leg via a mechanical joint connection and the protective pads are removable at the joint connection.

6. The clamp according to claim 1 wherein said molded U-shaped plastic clamp portion has a first melting point and said plastic molded threaded screw portion has a second melting point that is higher than the first melting point of said molded U-shaped plastic clamp portion.

7. The clamp according to claim 1 wherein said swivel portion is plastic.

8. The clamp according to claim 7 wherein said swivel portion has a first melting point and said plastic molded threaded screw portion has a second melting point that is higher than the first melting point of said swivel portion.

9. The clamp according to claim 1 wherein said molded U-shaped plastic clamp portion and said plastic molded screw portion have a molded connection.

10. The clamp according to claim 1 wherein said plastic molded screw portion and said swivel portion have a molded connection.

* * * * *